US006942212B2

(12) United States Patent
Koh

(10) Patent No.: US 6,942,212 B2
(45) Date of Patent: Sep. 13, 2005

(54) MECHANICAL MEDIA TOP LEVEL ELEVATOR

(75) Inventor: Wui Jein Koh, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 232 days.

(21) Appl. No.: 10/325,363

(22) Filed: Dec. 19, 2002

(65) Prior Publication Data

US 2003/0201597 A1 Oct. 30, 2003

(30) Foreign Application Priority Data

Apr. 26, 2002 (SG) ..... 200202540

(51) Int. Cl.[7] ..... B65H 14/00
(52) U.S. Cl. ..... 271/156; 271/160
(58) Field of Search ..... 271/156, 152–155, 271/160

(56) References Cited

U.S. PATENT DOCUMENTS 4,362,297 A * 12/1982 Landa ..... 271/152
4,930,763 A * 6/1990 Horii et al. ..... 271/31
5,078,380 A * 1/1992 Kitazawa ..... 271/9.05
5,215,299 A * 6/1993 Luft ..... 271/160
5,501,444 A * 3/1996 Yukimachi et al. ..... 271/127
5,584,476 A * 12/1996 Marzullo et al. ..... 271/126
6,260,839 B1 * 7/2001 Araki et al. ..... 271/10.11
6,354,586 B1 * 3/2002 Samoto ..... 271/127
6,422,773 B1 * 7/2002 Lim ..... 400/710
6,457,707 B1 * 10/2002 Hendrix et al. ..... 271/117
6,672,579 B2 * 1/2004 Araki et al. ..... 271/122
6,783,126 B2 * 8/2004 Amamoto ..... 271/152

* cited by examiner

*Primary Examiner*—Khoi H. Tran

(57) ABSTRACT

A media handling mechanism in a printing device includes an input tray for holding a stack of media sheets at a top level. The input tray includes a platform on which the stack of media sheets rests. The media handling mechanism also has a driving means coupled to the input tray for driving the platform upward toward a media pick mechanism of the printing device and a restricting mechanism connected to the input tray. The restricting mechanism stops upward movements of the platform toward the media pick mechanism when the top level of the stack of media reaches a first predetermined level.

9 Claims, 3 Drawing Sheets

MECHANICAL MEDIA TOP LEVEL ELEVATOR

BACKGROUND

This invention relates generally to media handling mechanisms, and more particularly to techniques for maintaining the top level of a stack of media sheets in a printing device.

A printing device, for example a printer, normally includes an input tray for accommodating a stack of media sheets. During printing operations, a pick mechanism in the printer continuously picks and feeds an individual media sheet atop the media stack to a print zone for imprinting images on it. As the media sheets are consumed, the media stack height decreases. Normally, such a decrease in the media stack height would lead to a decrease in a top level of the media stack and consequently an increase in a displacement between the pick mechanism and the top of the media stack. The increase in the displacement may result in a large variation of pick angle or pick force and may inevitably affect pick performance of the printer.

Solutions have been introduced to maintain the top level of the media stack. For example, an electrical motor with a feedback controller can be used to maintain a constant top level of the media stack. However, such a design occupies space and may increase the product cost due to its complexity. In addition, an electrical system may also require a higher electrical power consumption by the product.

Therefore, there is a need for a convenient and effective way to maintain the top level of the media stack in a printing device.

SUMMARY

According to the present invention, a media handling mechanism in a printing device includes an input tray for holding a stack of media sheets at a top level. The input tray includes a platform on which the stack of media sheets rests. The media handling mechanism also has a driving means coupled to the input tray for driving the platform upward toward a media pick mechanism of the printing device and a restricting mechanism connected to the input tray. The restricting mechanism stops upward movements of the platform toward the media pick mechanism when the top level of the stack of media reaches a first predetermined level.

According to a second aspect of the invention, a media handling mechanism in a printing device includes an input tray for holding a stack of media sheets at a top level, and the input tray includes a platform on which the stack of media sheets rest. The media handling mechanism also includes a spring mechanism coupled to the input tray for driving the platform toward a media pick mechanism of the printing device, an indexer mounted to the input tray and a pawl also mounted to the input tray. The indexer has a plurality of engaging teeth, while the pawl has an engaging end for interacting with one of the engaging teeth. Furthermore, the engaging end is movable between a first position in which the engaging end engages said one of the engaging teeth for preventing the spring mechanism from driving the platform toward the media pick mechanism when the top level of the-stack of media sheets reaches a first level, and a second position in which the engaging end disengages said one of the engaging teeth such that the spring mechanism is free to drive the platform toward the media pick mechanism when the top level reaches a second level.

According to a further aspect of the invention, in a method for maintaining a top level of a media stack within a predetermined range during printing operations, the media stack rests on a platform of an input tray in a printing device. The platform is biased toward a media pick mechanism of the printing device. Furthermore, the platform is kept in position during printing operations until the top level reaches a second predetermined level due to consumption of the media stack. When the top level has reached the second predetermined level, the platform is driven upward toward the media pick mechanism. Subsequently, when the top level reaches a first predetermined level, any upward movements of the platform toward the media pick mechanism will be stopped.

Other aspects and advantages of the invention will become apparent from the following detailed description in conjunction with the accompanying drawings; the description illustrates by way of example the principles of the invention.

DETAILED DESCRIPTION OF THE INVENTION

Figure 1:
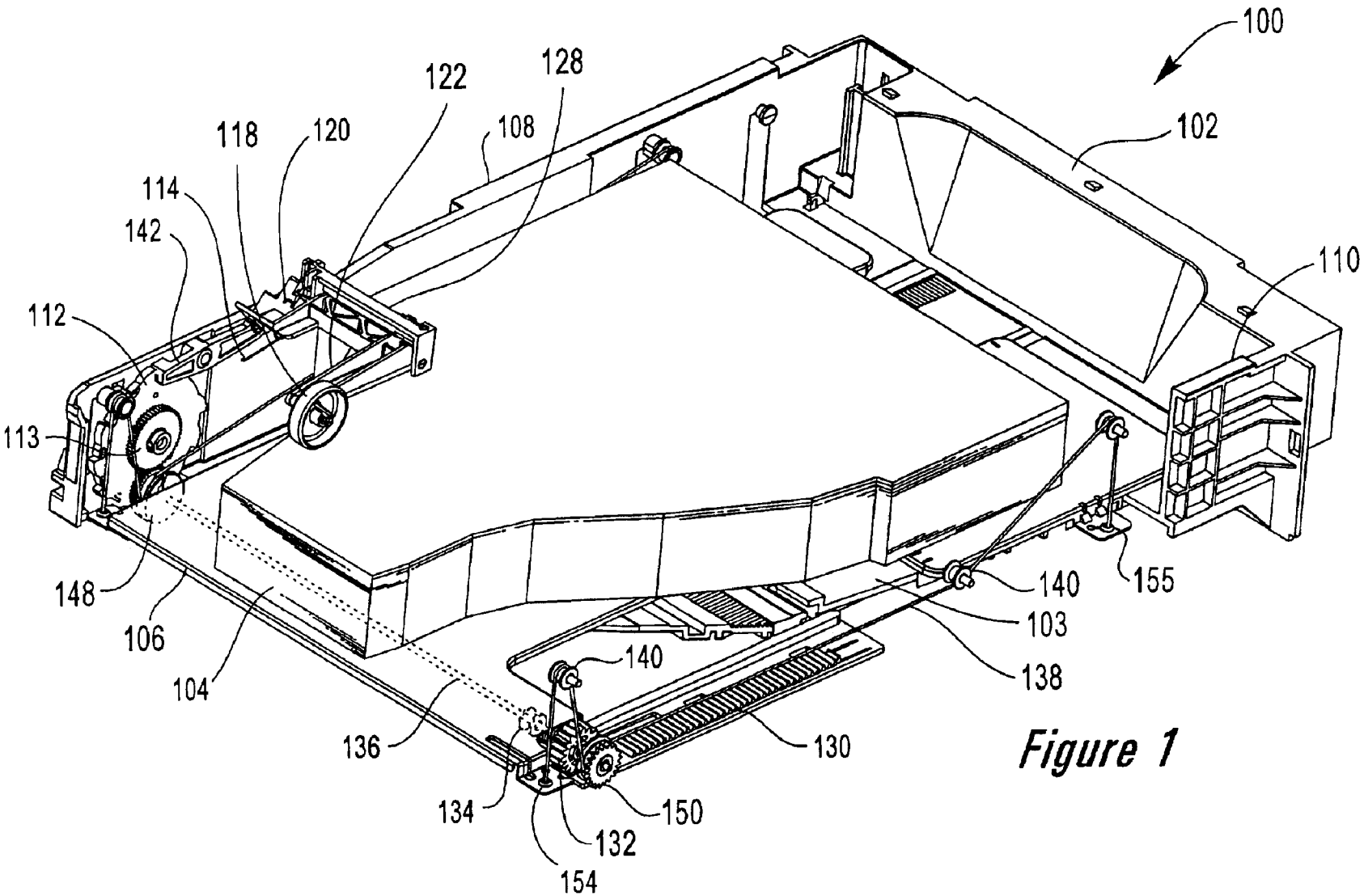
FIG. 1 is a perspective view of an input tray in a printer with a media top level elevating mechanism according to an embodiment of the invention.

In FIG. 1, is shown an input tray 100 in a printer with a media top level elevating mechanism according to an embodiment of the invention. The input tray 100 has a tray case 102 for accommodating a stack of media sheets 104 (hereinafter "media stack"). A media pick mechanism (not shown) above the input tray in the printer continuously picks and feeds an individual media sheet atop the media stack 104 to a print zone (not shown) for imprinting images on it. The tray case 102 has a pair of side walls 108, 110 and a case base 103 between the side walls. In addition, the input tray 100 has a platform 106 between the side walls, and the media stack 104 rests on the platform 106. The platform is not directly connected to the tray case 102 and is movable in the printer in either an upward or a downward direction.

Figure 3:
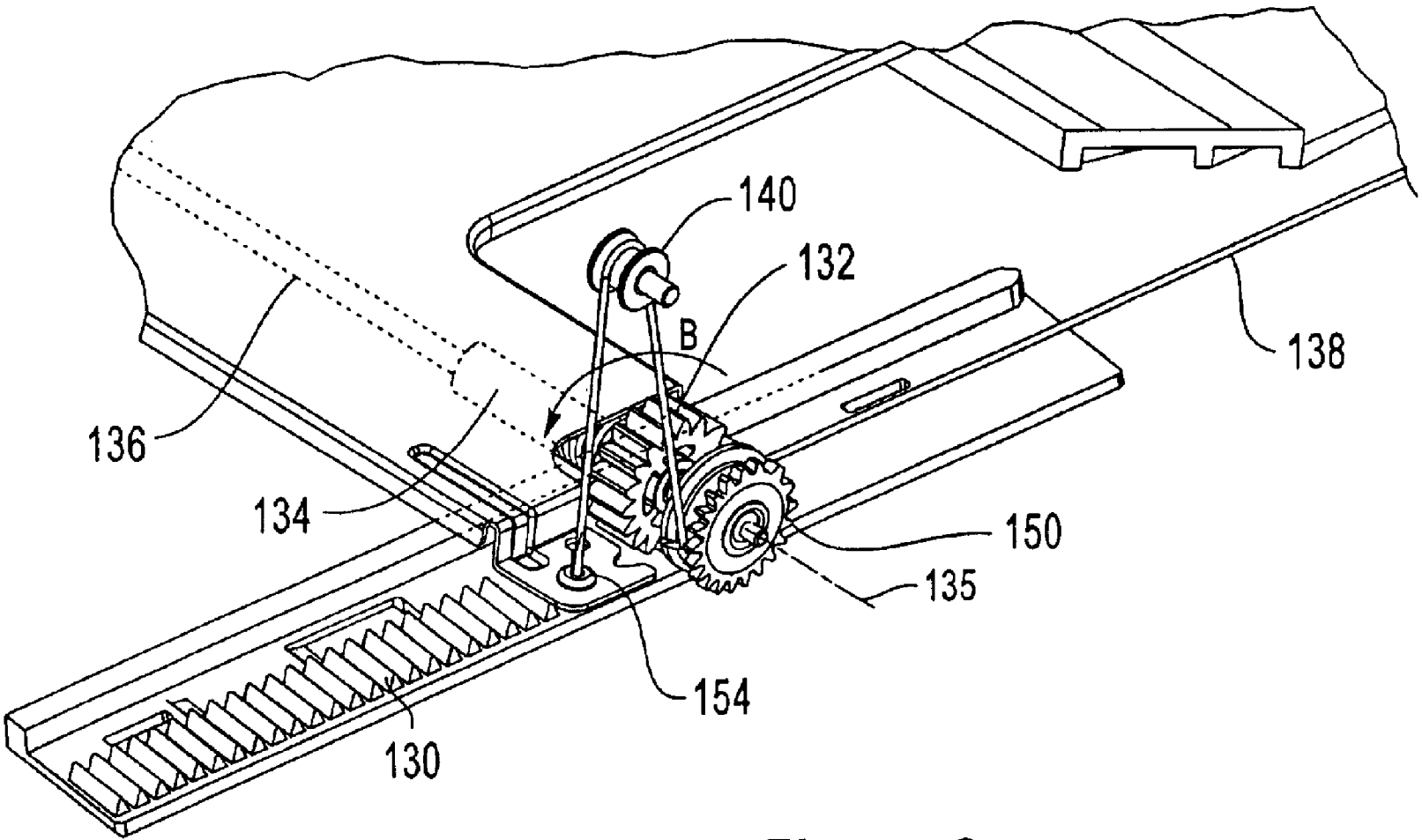
FIG. 3 is a close-up view of another portion of the media top level elevating mechanism of FIG. 1.

A winch shaft 136 between the side walls 108, 110 is mounted to the input tray under the platform 104 and is rotatable about an axis 135 (see FIG. 3). Furthermore, a torsion spring 134 with one end mounted on the winch shaft 136 winds around the winch shaft 136. The other end of the torsion spring 134 is mounted on a wind gear 132, which is freely rotatable about the winch shaft 136 and is located on the left side of the winch shaft 136.

In FIG. 3, when the input tray 100 is inserted into a printer structure (not shown) of the printer, the wind gear 132 interacts with a rack 130 mounted on the printer structure for winding up the torsion spring 134. The rack 130 has a set of teeth and extends in the direction in which the input tray is inserted. Since the rack 130 is mounted on the printer structure, the input tray 100 as well as the wind gear 132 moves relative to the rack 130 when the input tray 100 is inserted. As a result, the teeth of the rack 130 interact with the wind gear and consequently rotate the wind gear 132 in a counterclockwise direction as shown by arrow B in FIG. 3. Additionally, during the insertion of the input tray 100, the winch shaft 136 as well as the end of the torsion spring mounted on the shaft will be restricted from rotation (to be discussed later). Thus, rotation of the wind gear 132 in the counterclockwise direction winds up the torsion spring 134, and the torsion spring 134 is biased to store energies therein.

Being wound up, the torsion spring 134 has a biasing force, which supports the platform 106 and the media stack 104 loaded. Furthermore, the torsion spring, the wind gear and the rack are configured such that when the input tray 100 is fully inserted, the biasing force provided by the torsion spring 134 that has been wound up is more than enough to support the platform 106 and the media stack loaded. Thus, when the input tray 100 is fully inserted, the torsion spring 134 tends to unwind itself due to its own biasing force if there is no restriction on either of its two ends. Note that when the input tray 100 is fully inserted, it is locked in position by a plunger (not shown). Unless actively released by a user, the input tray 100 as well as the wind gear 132 does not move relative to the rack 130. Therefore, when the input tray 100 remains fully inserted in the printer, the torsion spring 134 unwinds itself only when the winch shaft 136 is free to rotate about the axis 135. Furthermore, as the torsion spring 134 unwinds itself, the biasing force of the torsion spring 134 drives the winch shaft 136 and accordingly a pair of winches 148, 150 respectively mounted at two opposite sides of the winch shaft 136 to rotate in the counterclockwise direction B. A pair of wire ropes 138, each with one end mounted at a first position 154 of the platform and the other end at a second position 155 of the platform, respectively pass through a plurality of pulleys 140 mounted on the sides walls 108, 110 and wind around the winches. When the winch shaft 136 rotates in the counterclockwise direction, the winches 148, 150 wind up the wire ropes 138. As a result, the platform 106 and the top level of the media stack 104 will be raised. On the other hand, when the wire ropes unwind, the platform will be lowered.

Figure 2:
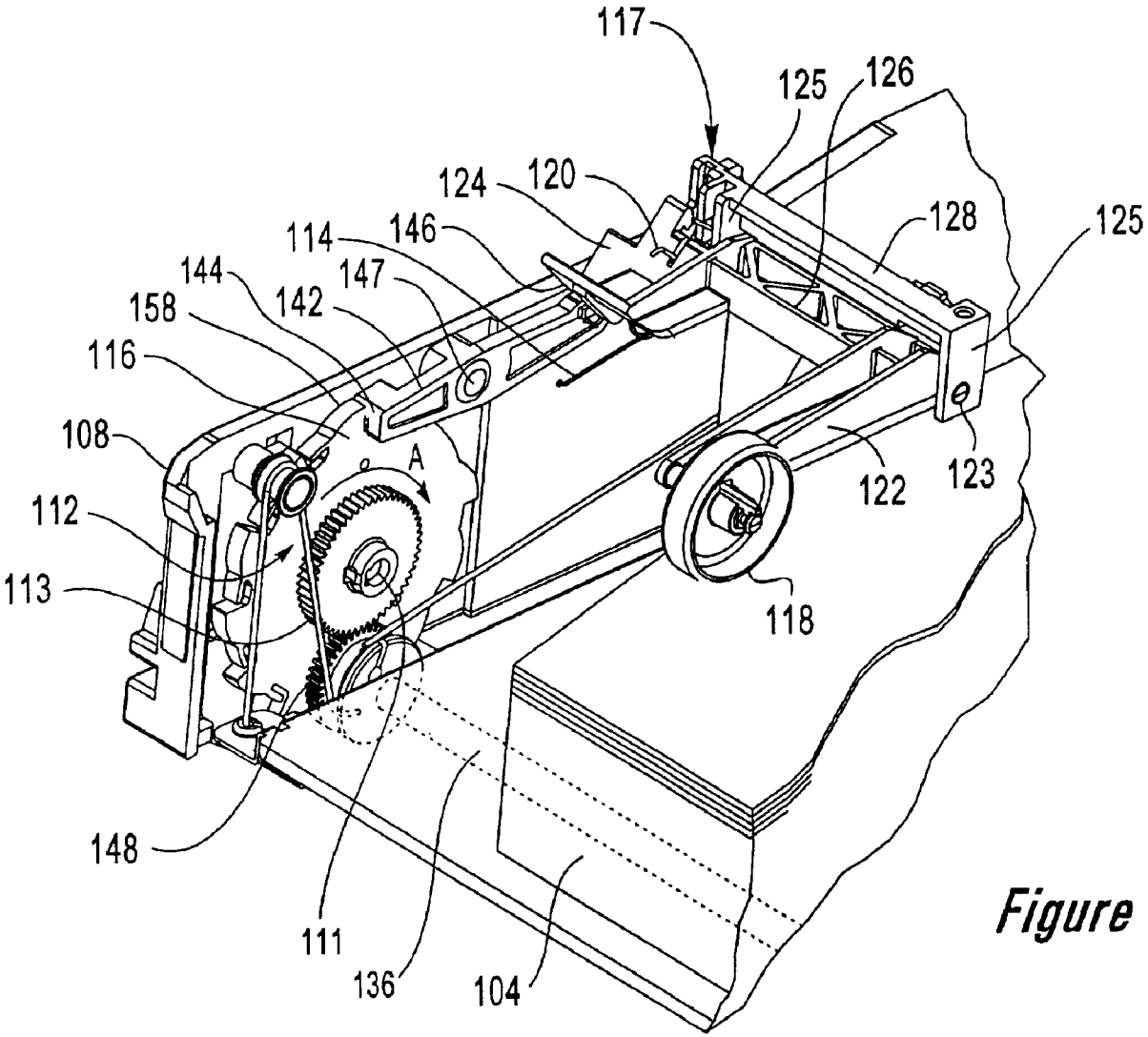
FIG. 2 illustrates in detail a portion of the media top level elevating mechanism of FIG. 1.

In FIGS. 1 and 2, a wheel indexer 112 having a plurality of ratchet teeth 116 is mounted on the right side wall 108 of the input ray 100 and is rotatable about an indexer axle 111. The wheel indexer 112 interacts with the winch shaft 136 through the engagement between the right winch 148 on the winch shaft 136 and an indexer gear 113, which is mounted on the wheel indexer 112 and also rotates about the indexer axle 111. In this way, when the winch shaft 136 rotates in the counterclockwise direction, the wheel indexer 112 is driven to rotate in a clockwise direction accordingly. On the other hand, when the rotation of the wheel indexer 112 is stopped, the winch shaft 136 and the winches also stop rotating due to the engagement between the right winch 148 and the indexer gear 113.

A pawl 142 mounted on the right side wall 108 has an engaging end 144 engagable with one of the ratchet teeth 116 of the wheel indexer 112. When the engaging end 144 engages one of the ratchet teeth 116, such an engagement stops the rotation of the wheel indexer 112 and consequently the rotation of the winch shaft 136. When the engaging end disengages said one of the ratchet teeth 116, however, the wheel indexer 112 is free to rotate. Furthermore, as shown in FIG. 2, each ratchet tooth has a steep engaging surface 156 facing the engaging end 144 for the engagement therebetween. Each ratchet tooth also has a non-engaging surface 158, which can be an incline opposite the engaging end 144 and connects a highest point and a lowest point of respective engaging surfaces of adjacent ratchet teeth. The engagement between the ratchet teeth 116 and the engaging end 144 only restricts the wheel indexer 112 from rotating in the clockwise direction as shown by arrow A in FIG. 2. If the wheel indexer 112 rotates in the counterclockwise direction, however, the engaging end 144 simply slips over the non-engaging surfaces of the ratchet teeth and does not disturb such rotation.

The pawl 142 is rotatable about a pawl axle 147 on the right side wall 108 and includes a sensing end 146 at the other end. When the input tray 100 is fully inserted into the printer, the sensing end 146 can interact with a probe mechanism 117 mounted on the printer structure to obtain information about the top level of the media stack 104. Furthermore, an indexer spring 114 mounted on the right side wall 108 biases the sensing end 146 in an upward direction so as to keep the pawl 142 engaged to the wheel indexer 112. The pawl is configured such that as it engages the wheel indexer, it extends substantially horizontally, while the engaging surface 156 of the engaged ratchet tooth is substantially perpendicular to it.

As shown in FIG. 2, the probe mechanism 117 includes a pair of probe arms 122, 124 connected by a bridge 126, and is mounted to the printer structure (not shown) through a probe mount 128. The probe mount 128 has a pair of parallel walls 125, each wall has an aperture 123 on it, and each probe arm has a cylindrical protrusion (not shown) which hinges with the apertures on the probe mount 128. In this way, the probe mechanism 117 is mounted on the printer structure, with the bridge 126 as well as the pair of probe arms rotatable about an axis (not shown) passing through the centers of the apertures. In addition, the probe arms are substantially parallel to the right side wall 108, while the bridge 126 is substantially perpendicular to the right side wall 108.

In FIG. 2, the probe mechanism 117 also includes a probe roller 118 at an end of the left probe arm 122, resting atop the media stack 104. A probe spring 120 attached to the probe mount 128 biases the probe arms 122, 124 downwards so as to keep the probe roller 118 in contact with the top of the media stack 104. Thus, the position of the probe roller 118 reflects the top level of the media stack.

As the media stack 104 is consumed during printing operations, the media stack height decreases and the probe arms 122, 124 will rotate downward, since they are biased by the probe spring 120 to keep the probe roller 118 in contact with the top of the media stack 104. The right probe arm 124, which is positioned to interact with the sensing end 146 of the pawl 142, accordingly pushes the sensing end 146 downward. When the rotation of the pawl about the pawl axle 147 in the clockwise direction exceeds a certain amount, that is, when the top level of the media stack has reached a predetermined low level, the engaging end 144 of the pawl 142 disengages the wheel indexer 112. As previous discussed, when the pawl 142 disengages the wheel indexer 142, the torsion spring 134 will unwind itself due to its own biasing force so as to raise the platform 106 and accordingly the top level of the media stack 104.

As the top level of the media stack 104 rises, the probe roller 118 is pushed upwards by the media stack 104 and the probe arms 122, 124 rotate upward accordingly. With the right probe arm 124 moving upward, the pawl 142 rotates in the counterclockwise direction, since it is biased by the indexer spring 114 to engage one of the ratchet teeth 116. On the other hand, driven by the winch shaft 136 through the right winch 148 and the indexer gear 113, the wheel indexer 112 rotates in the clockwise direction shown by arrow A in FIG. 2 as the torsion spring 134 unwinds. Therefore, the engaging end 144 will not engage the wheel indexer 112 until it meets another ratchet tooth of the wheel indexer 112.

In other words, the engaging end 144 engages the wheel indexer 112 only when the torsion spring 134 has unwound a certain amount and the top level of the media stack 104 has been raised to a predetermined high level. When the engaging end 144 engages the wheel indexer 112, the rotation of the wheel indexer 112 and consequently the unwinding of the torsion spring 134 are stopped. In this manner, the movement of the platform 106 in the upward direction is also stopped, and the top level of the media stack 104 stops increasing.

In addition, a tray cover (not shown) with a hole on it is mounted on the right side wall 108 above the pawl 142. The tray cover and the hole are configured such that only when the input tray 100 is fully inserted into and remain in the printer, can the right probe arm 124 pass through the hole and interact with the sensing end 146 of the pawl 142. During the insertion or removal of the input tray 100, the tray cover prevents the probe mechanism 117 from interacting with the pawl 142.

Elevation of the Top Level

When the input tray is outside the printer and when the media stack 104 is loaded into the input tray 100, the platform 106 drops to its lowest position due to the weights of the platform 106 and the media stack 104. Note that at this stage, the torsion spring is not wound up and does not provide the biasing force for supporting the platform. Furthermore, as the platform drops, the wheel indexer 112 rotates in the counterclockwise direction due to the unwinding of the wire ropes 138; this unwinding causes the winches and the winch shaft 136 to rotate in the clockwise direction. As discussed before, the wheel indexer is free to rotate in the counterclockwise direction without being disturbed by the pawl 142. Thus, the platform 106 drops to its lowest position.

During the insertion of the input tray 100 into the printer structure, the rack 130 interacts with the wind gear 132 to wind up the torsion spring 134. Winding of the torsion spring 134 produces a biasing force, which tends to unwind the torsion spring itself. In the beginning, if there is no engagement between the pawl and the wheel indexer, the biasing force also drives the winch shaft 136 to rotate in the counterclockwise direction and consequently the wheel indexer 112 to rotate in the clockwise direction. Since the pawl 142 is biased to extend horizontally, the pawl 142 engages one of the ratchet teeth of the wheel indexer 112 when the wheel indexer has rotated a certain amount in the clockwise direction. Due to such an engagement, the rotation of the wheel indexer and further the rotation of the winch shaft are stopped. As the input tray 100 is further inserted, the interaction between the rack 130 and the wind gear 132 winds up the torsion spring 135.

When the input tray is fully inserted, it is locked by the plunger, as discussed before, such that the wind gear does not move relative to the rack during the ensuing operations.

Furthermore, when the input tray is fully inserted, the probe mechanism 117 mounted on the printer structure can interact with the pawl through the hole (not shown) on the tray cover. Since the platform 106 and the top of the media stack 104 are at the lowest position, the probe arms are biased downward to keep the probe roller 118 in contact with the top of the media stack 104. Consequently the right probe arm 124 presses the sensing end 146 of the pawl 112 downward, and the pawl disengages the wheel indexer 116. Then the torsion spring 134 is free to unwind itself due to its own biasing energy stored. Such an unwinding of the torsion spring 134 rotates the winch draft 136 in the counterclockwise direction. This rotation consequently raises the platform 106 and the top level of the media stack. As the top level rises up, the probe roller 118 and the right probe arm 124 move up accordingly. As a result, the engaging end 142 of the pawl rotates downward since it is biased by the indexer spring 114 to engage the wheel indexer 112. Furthermore, rotation of the winch draft 136 also drives the wheel indexer 112 to rotate in the clockwise direction until the pawl 142 engages another ratchet tooth of the wheel indexer 112. As discussed, the engagement between the pawl 142 and the wheel indexer 112 stops the unwinding of the torsion spring 134 and the rise of the platform 106. In addition, the intervals among adjacent ratchet teeth, the pawl and the probe mechanism are configured such that when the pawl 142 engages the wheel indexer 112, the top level of the media stack 104 is raised to approximately the predetermined high level. Furthermore, during printing operations, the platform 106 will not be further raised so long as such an engagement exists.

As the media stack 104 is consumed and the media stack height decrease, the top level of the media stack 104 drops accordingly. When the top level reaches the predetermined low level, the pawl 142 disengages the wheel indexer 112 when the sensing end 146 is pressed downward by the right probe arm 124 of the probe mechanism 117. Then the torsion spring 134 is free to unwind itself. Similarly, the platform and the top level are raised until the pawl 142 engages the wheel indexer 112. At that time, the top level of the media stack 104 has been raised to approximately the predetermined high level. Once the pawl 142 engages the wheel indexer 112, the unwinding of the torsion spring and the rise of the top level of the media stack are stopped. Thus, the top level of the media stack 104 is maintained within a range between the predetermined high level and the predetermined low level. By selecting the intervals among the ratchet teeth of the wheel indexer, the length of the pawl, the length of the probe arms, the diameter of the wheel indexer and the diameter of the probe roller, such a range can be predetermined.

When the input tray 100 is pulled out of the printer, the interaction between the rack and the wind gear unwinds the torsion spring. When the wind gear separates with the rack, which means that the torsion spring is not restricted from unwinding itself by the wind gear, the platform will drop to its lowest position due to the weights of the platform and the media stack on it.

Alternatives can be made to the preceding embodiment. For example, a tension spring placed under the platform 106 with an end fixed to the case base 103 can be used to replace the torsion spring 134 for driving the platform in the upward direction. In that case, the rack 130 and the winches 148, 150 may not be necessary. The rise of the platform 106 can be stopped by the interaction between an indexer and the pawl. In addition, in such a mechanism, the user may need to press the platform down while loading the media stack when the input tray is out of the printer due to the constantly upward biasing force of the spring.

Furthermore, the whole probe mechanism 117 can be taken away. In that case, the sensing end 146 of the pawl 142 rests atop the media stack 104 directly for determining the top level of the media stack. In that case, the sensing end 146 needs to be biased to be in contact with the top of the media stack. The probe mechanism 117 in the previous discussed exemplary embodiment helps to minimize any possible adverse impacts on the pick-up of media sheets due to the pressure exerted on the media stack caused by the engagement between the pawl and the wheel indexer.

Only printers are discussed in the exemplary embodiment. It is understood that the media handling mechanism of the invention is also suitable for other printing devices such as copiers and fax machines.

What is claimed is:

1. A media handling mechanism in a printing device, comprising:

an input tray for holding a stack of media sheets at a top level, wherein the input tray includes two side walls and a platform on which the stack of media sheets rests;

a spring mechanism coupled to the input tray for driving the platform upward toward a media pick mechanism of the printing device;

a wheel indexer mounted to one side wall of the input tray for stopping upward movements of the platform toward the media pick mechanism when the top level of the stack of media reaches a first predetermined level;

a sensing mechanism for determining the top level of the stack of media;

an engaging mechanism mounted to the same side wall of the input tray, said engaging mechanism having an engaging end configured to engage with the wheel indexer when the top level of the stack of media reaches the first predetermined level and a sensing end configured to interact with the sensing mechanism; and a disengaging mechanism for disengaging the engaging mechanism with the wheel indexer when the top level of the stack of media reaches a second level lower than the first level so that the spring mechanism is free to drive the platform toward the media pick mechanism.

2. The media handling mechanism of claim 1, wherein the spring mechanism includes a torsion spring wound around a shaft mounted to the input tray, wherein unwinding of the torsion spring drives the platform toward the media pick mechanism, and wherein the wheel indexer is coupled to the shaft for stopping the unwinding of the torsion spring when the top level of the stack of media reaches the first predetermined level.

3. The media handling mechanism of claim 1, wherein the sensing mechanism is positioned to rest atop the stack of media for determining the top level of the stack of media.

4. The media handling mechanism of claim 2, wherein said wheel indexer has at least one ratchet tooth to engage with the engaging mechanism.

5. A media handling mechanism in a printing device, comprising:

an input tray for holding a stack of media sheets at a top level, wherein the input tray comprises two side walls and a platform on which the stack of media sheets rest;

a spring mechanism coupled to the input tray for driving the platform upward toward a media pick mechanism in the printing device;

a rotatable wheel indexer having a plurality of engaging teeth mounted to the input tray;

a sensing mechanism for determining the top level of the stack of media sheets; and a pawl having an engaging end for interacting with one of the engaging teeth mounted to the input tray and a sensing end configured to interact with the sensing mechanism, wherein the engaging end is movable between a first position in which the engaging end engages said one of the engaging teeth for preventing the spring mechanism from driving the platform toward the media pick mechanism when the top level of the stack of media sheets reaches a first level, and a second position in which the engaging end disengages said one of the engaging teeth so that the spring mechanism is free to drive the platform toward the media pick mechanism when the top level reaches a second level lower than the first level.

6. The media handling mechanism of claim 5, wherein the pawl is rotatable about an axle mounted on the input tray, and wherein the engaging end and the sensing end are located at two opposite sides of the axle respectively.

7. The media handling mechanism of claim 6, further comprising a probe roller resting atop the stack of media sheets for determining the top level, and means for transmitting the top level determined by the probe roller to the pawl.

8. The media handling mechanism of claim 7, wherein said means for transmitting including a pair of substantially parallel arms connected by a bridge therebetween, wherein one arm holds the probe roller at an end, and wherein the other arm interacts wiht the sensing end of the pawl.

9. The media handling mechanism of claim 2, wherein both the pawl and the wheel indexer are mounted on the same side wall.

* * * * *

UNITED STATES PATENT AND TRADEMARK OFFICE

CERTIFICATE OF CORRECTION

PATENT NO. : 6,942,212 B2
DATED : September 13, 2005
INVENTOR(S) : Wui Jein Koh

It is certified that error appears in the above-identified patent and that said Letters Patent is hereby corrected as shown below:

Column 8,
Line 40, “wiht” should read -- with --.

Signed and Sealed this

Sixth Day of December, 2005

JON W. DUDAS
*Director of the United States Patent and Trademark Office*